US007000987B2

(12) United States Patent
Staarink

(10) Patent No.: US 7,000,987 B2
(45) Date of Patent: Feb. 21, 2006

(54) DEVICE FOR SUPPORTING A SEATED PERSON AND METHOD FOR ADJUSTING, DESIGNING AND/OR MANUFACTURING SUCH A DEVICE

(75) Inventor: Henricus Antonius Maria Staarink, Numansdorp (NL)

(73) Assignee: Richard van Seenus Nederland B.V., (NL)

( * ) Notice: Subject to any disclaimer, the term of this patent is extended or adjusted under 35 U.S.C. 154(b) by 0 days.

(21) Appl. No.: 10/203,854

(22) PCT Filed: Feb. 19, 2001

(86) PCT No.: PCT/NL01/00142

§ 371 (c)(1),
(2), (4) Date: Nov. 19, 2002

(87) PCT Pub. No.: WO01/60209

PCT Pub. Date: Aug. 23, 2001

(65) Prior Publication Data

US 2003/0107250 A1 Jun. 12, 2003

(30) Foreign Application Priority Data

Feb. 17, 2000 (NL) ..... 1014412

(51) Int. Cl.
*A47C 7/46* (2006.01)

(52) U.S. Cl. ..... 297/284.7; 297/354.11; 297/353

(58) Field of Classification Search ..... 297/284.7, 297/284.9, 353, 354.1, 284.8, 408, 410
See application file for complete search history.

(56) References Cited

U.S. PATENT DOCUMENTS

| | | | | | |
|---|---|---|---|---|---|
| 2,619,157 | A | * | 11/1952 | Boone et al. | 297/284.9 |
| 3,121,592 | A | | 2/1964 | Anderson | |
| 3,608,960 | A | * | 9/1971 | Sherman | 297/284.9 |
| 5,425,566 | A | * | 6/1995 | Buchacz | 297/353 X |
| 5,730,688 | A | * | 3/1998 | Prusick | 297/353 X |
| 5,975,634 | A | | 11/1999 | Knoblock et al. | 297/300.4 |
| 6,062,649 | A | * | 5/2000 | Nagel et al. | 297/284.7 |
| 6,079,785 | A | * | 6/2000 | Peterson et al. | 297/284.7 |
| 6,257,664 | B1 | * | 7/2001 | Chew et al. | 297/284.9 |

FOREIGN PATENT DOCUMENTS

| | | | |
|---|---|---|---|
| FR | 1303089 | | 9/1962 |
| WO | WO 8909557 | A * | 10/1989 |

* cited by examiner

*Primary Examiner*—Anthony D. Barfield
(74) *Attorney, Agent, or Firm*—Todd R. Fronek; Westman, Champlin & Kelly

(57) ABSTRACT

A device for supporting a seated person, comprising a seat and a support for the lumbar-thoracic transition region, which is connected to the seat, and characterized by an adjustable lumbar-sacral support, which is mounted at a location of a lower side of the support for the lumbar-thoracic transition region. Preferably, an adjustable support is furthermore provided for the thoracic-cervical transition region, which support is mounted at the location of the upper side of the support for the lumbar-thoracic transition region.

20 Claims, 5 Drawing Sheets

DEVICE FOR SUPPORTING A SEATED PERSON AND METHOD FOR ADJUSTING, DESIGNING AND/OR MANUFACTURING SUCH A DEVICE

CROSS-REFERENCE TO RELATED APPLICATION

This Application is a Section 371 National Stage Application of International Application No. PCT/NL01/00142 tiled Feb. 19, 2001 and published as WO 01/60209 on Aug. 23, 2001, in English.

FIELD OF THE INVENTION

The invention relates to a device for supporting a seated person, comprising a seat and a support for the lumbar-thoracic transition region, which is connected to the seat.

BACKGROUND OF THE INVENTION

Such backrests are well-known, and they are usually connected to the rear side of the seat by means of a fixed pivot. Frequently, they consist of a basic frame, with respect to which part of the support can be moved to the front in the lumbar region so as to follow the individual curvature of the spinal column in the lumbar region (indicated by letters "AB" in FIG. 1). Moving said support part to the front can be done mechanically or pneumatically. Frequently, said supporting region can be adjusted in vertical direction as well, since the location of the deepest point of the lumbar region of the spine can vary with each individual person. One drawback of these solutions is that only a marginal individual optimization can be achieved. The adjusting range for moving the lumbar support to the front with respect to the seat is limited.

U.S. Pat. No. 3,121,592 relates to a chair intended to provide more comfortable support for the lumbar region of the occupant's back. To this end, the chair according to this publication comprises a fixed shoulder engaging panel and an automatically self-adjusting lumbar engaging member.

French patent application 1.303.089, concerns a similar chair, wherein the adjustable support is positioned lower, i.e. more towards the seat.

Shortcomings of the prior art will be explained by means of FIG. 2 attached to this description, which shows several possible forms of the lumbar region of the spine, ranging from a concave back or lordosis (numerals 1 and 2), via a flat back (3) to a convex back or kyfosis (4), whilst the posture of the upper body remains unchanged. The position on the seat relative to the backrest shifts forward accordingly. FIG. 3 shows the same postures for the concave back and the flat back, whilst the position of the seat remains unchanged. The difference is remarkable. It is impossible to bridge this difference with existing specific lumbar supports. Moreover, the posture is influenced to a significant degree by moving the lumbar support to the front, whilst the desired posture has already been determined earlier by adjusting the angle of the backrest. From a functional point of view, this is not logical. Furthermore, the extent of support in transverse direction decreases when the lumbar support is moved to the front. As a result, the desired lateral support of the pelvis decreases. This also is not logical from a functional point of view.

The basic frame of existing backrests usually consists of a hard shell which is lined with a foam, or of a frame in which foam-covered non-sag springs or webs are stretched in transverse direction. Such constructions exhibit a limited capability of adapting to the individual shape of the back and the pelvis. Usually the thoracic-cervical transition region (indicated by the letter "C" in FIG. 1) is not supported, and in those cases where it is attempted to do so by forming the upper part of the backrest with a curvature to the front, said curvature is not individually adjustable.

Some important drawbacks of existing forms of individually adjustable posture support are that, from a functional viewpoint, the adjusting process is not based on a logical order, that the adjusting ranges are too small, and that there is no adjustable support for the upper part of the back. As a result, an optimum result is usually not achieved.

BRIEF SUMMARY OF THE INVENTION

The object of the present invention is to provide an improved device of the type referred to in the introduction.

This objective is accomplished in the device according to claim 1.

Preferably, the lumbar-sacral support can be adjusted over a range, which enables forming both a convex support and a concave support together with the support for the lumbar-thoracic transition region.

It is further preferred that an adjustable support is provided for the thoracic-cervical transition region, which support is mounted at the location of the upper side of the support for the lumbar-thoracic transition region.

Thus, the support of the lumbar-thoracic transition region, i.e. the part of the back that extends approximately from the ninth thoracic vertebra from above (T9) to the second or third lumbar vertebra from above (L2/L3), can be used both functionally and constructionally for defining the desired posture first and subsequently supporting the lower part and preferably also the upper part of the back individually from there, irrespective of the shape of the individual back in sagittal and in transversal section. The individual posture support that can be achieved by this approach is maximal.

A special embodiment of this concept concerns a foldable solution. This makes it possible to use this new concept of posture support also in wheelchairs which can be adjusted for width.

DETAILED DESCRIPTION OF PREFERRED EMBODIMENTS

The invention functionally and constructionally plays along with the essence of the sitting posture. The essence is that the position of the upper body in space is determined by the lumbar-thoracic transition region (FIG. 1:1), irrespective of the shape of the back (FIG. 2). The shape of the back in the lumbar region defines the location of the lumbar-thoracic support with respect to the seat, starting from a fixed posture of the ischia in the seat. See FIGS. 2 and 3. In the case of a concave back (lordosis; FIGS. 2:1 and 2), the intersecting point of the tangent line of the back support with the seat (FIG. 3) will be located in front (tangent T1) of the rear side of the seat, in the case of a convex back (kyfosis) it will be located approximately at the rear side (tangent T2) of the seat. In order to achieve a satisfactory individual support, the backrest and the seat can be adjusted in forward-rearward direction with respect to each other, therefore. See also FIGS. 2 and 3. The adjusting range that can thus be achieved is much larger than is possible with a specific lumbar support.

Figure 1:
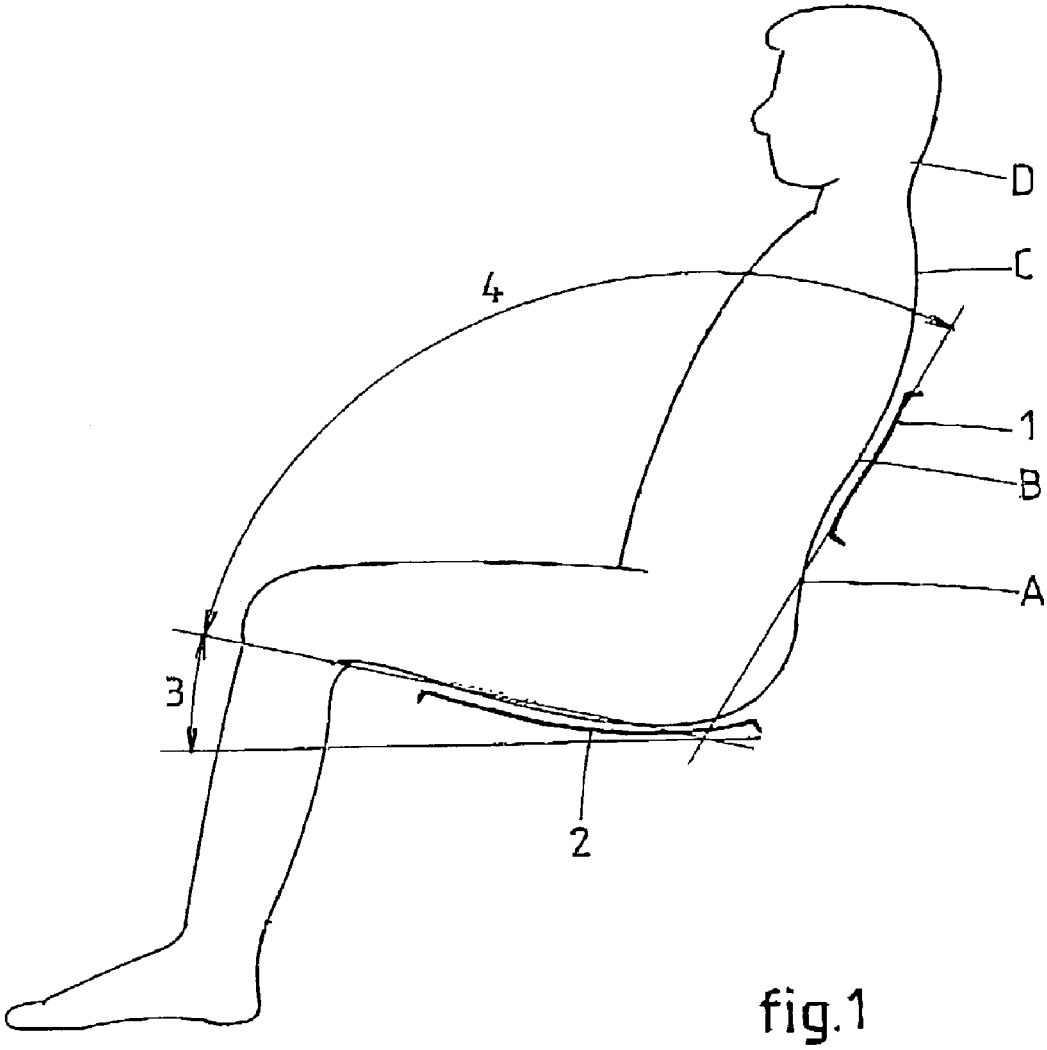
FIGS. 1–3 are diagrams useful in explaining support of a seated person.
Figure 2:
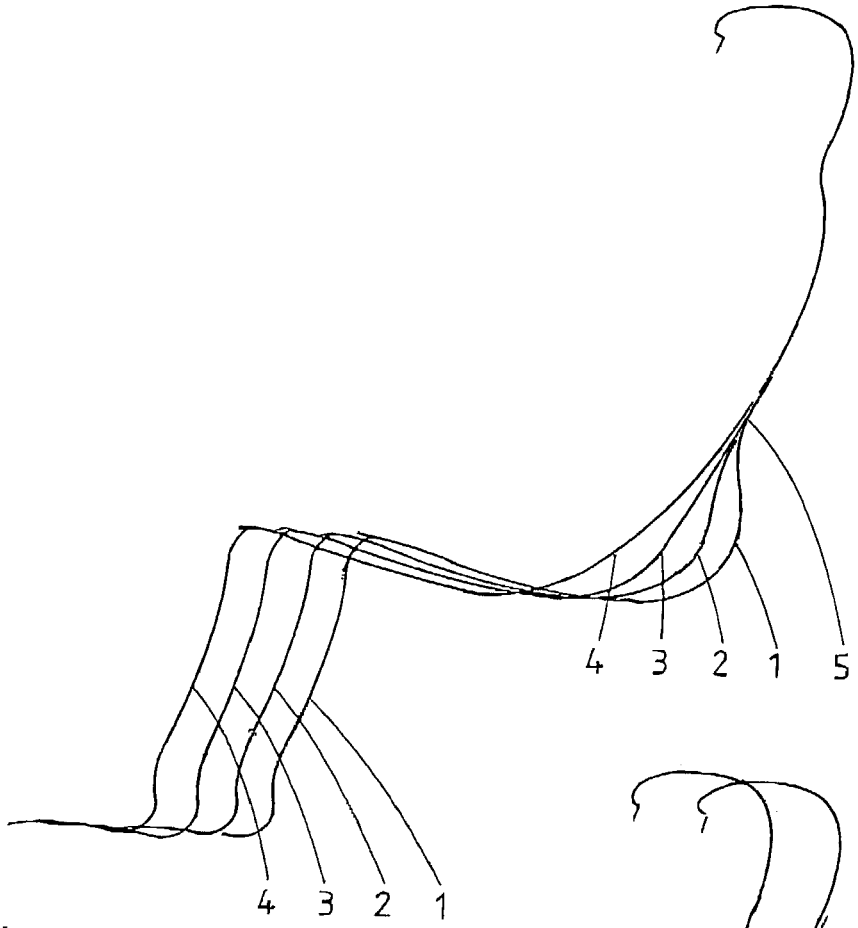
Figure 3:
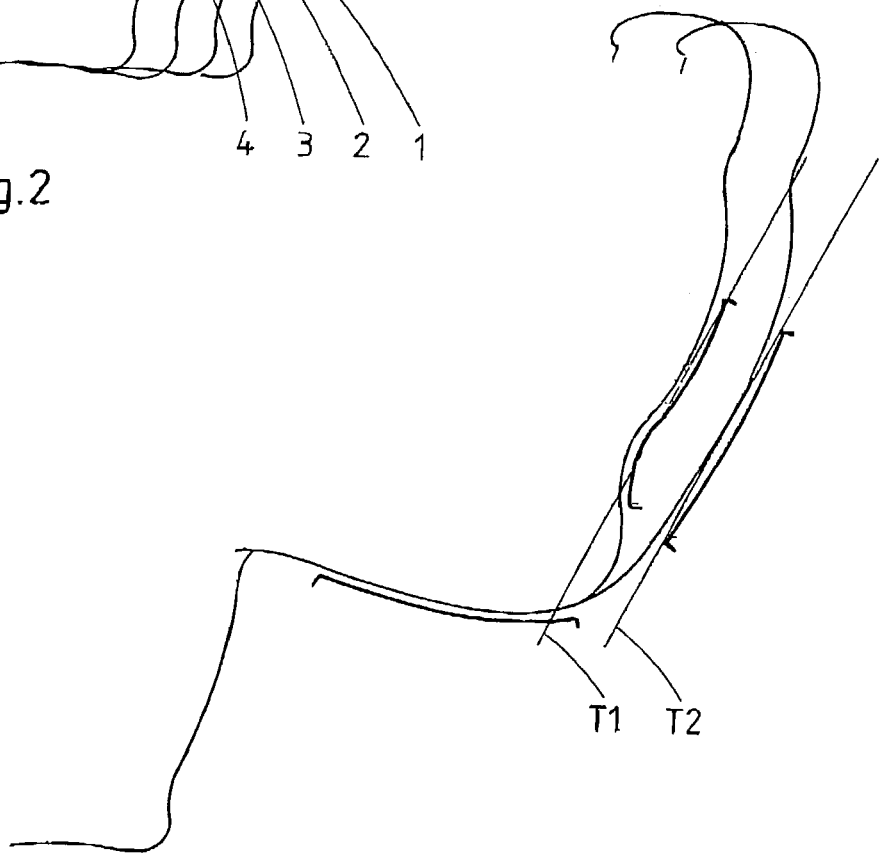

A stable, relaxed posture is characterized by a posture of the lumbar-thoracic transition region, which is about 25–35° off plumb (seat angle and sitting angle together about 115–125°, see FIGS. 1: 3 and 4). Not only is the torso given its stability in this posture, but also the higher thoracic-cervical transition region is maximally relaxed. In this posture the head is in a well-balanced posture on the torso, with a minimum amount of effort being required. As a result of the definition that is used, this posture is independent of the shape of a person's back and, within certain margins, it is the same for all persons (FIG. 2). Furthermore, the ratio between the seat angle and the sitting angle needs to be optimized in order to create maximum seating comfort. A correct ratio between the two angles (FIGS. 1: 3 and 4) eliminates the frictional forces on the seat. In order to achieve an individual optimization of this stable, relaxed posture the spinal column is preferably supported in its natural individual curvature as much as possible. Only in this manner is it possible to realise an optimally advantageous internal load while sitting. The intervertebral discs, the ligaments and the capsules in the spinal column are loaded in the most advantageous manner possible, while sufficient space for the belly remains. The neurophysiologic control of the posture and the sensorimotor feedback are optimal.

Not only does the present invention maximally accommodate the individual lumbar and thoracic shape of the spinal column, it also provides a logical and unequivocal adjusting procedure for achieving that result. To a certain extent this also guarantees that an optimum support is actually achieved in practice.

Since the posture in space of the lumbar-thoracic transition region (FIG. 1:1) constitutes the essence of the sitting posture, it is a characterizing feature of the new posture support concept that the central support of the lumbar-thoracic transition region of the spinal column forms the basis, both functionally and constructionally, of the posture support in longitudinal section and in cross-section.

Figure 4:
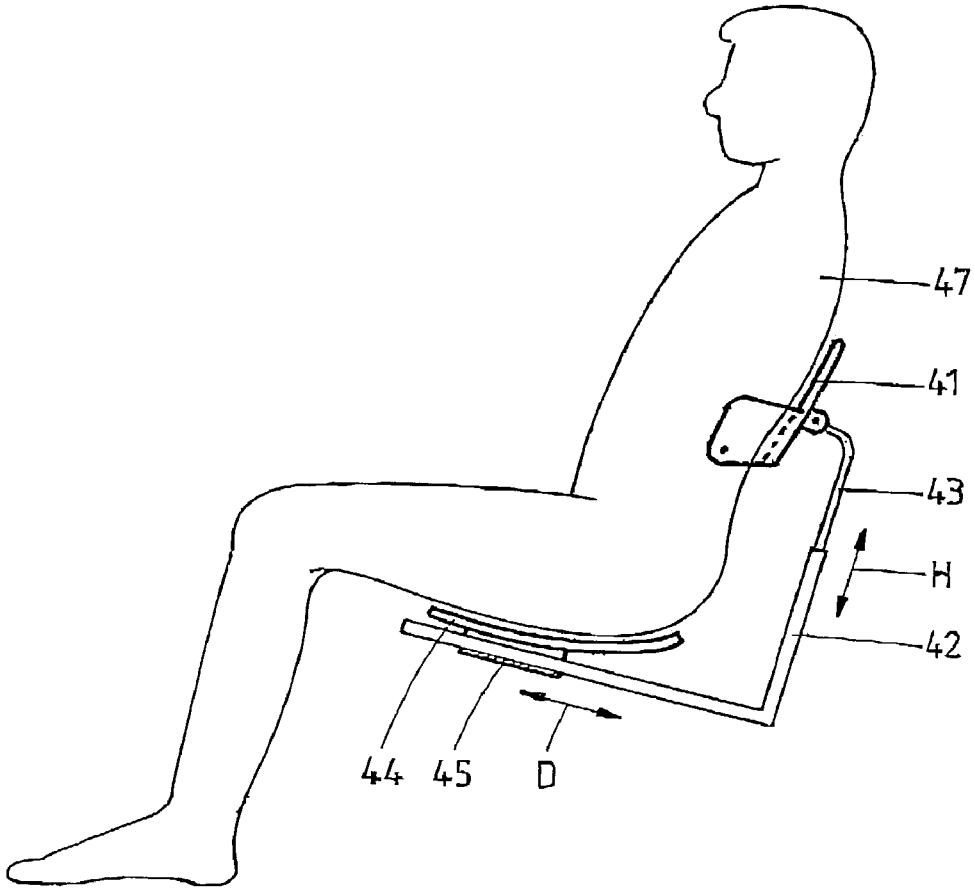
FIG. 4 is a side view of use of a support in accordance with a first embodiment of the present invention.
Figure 5:
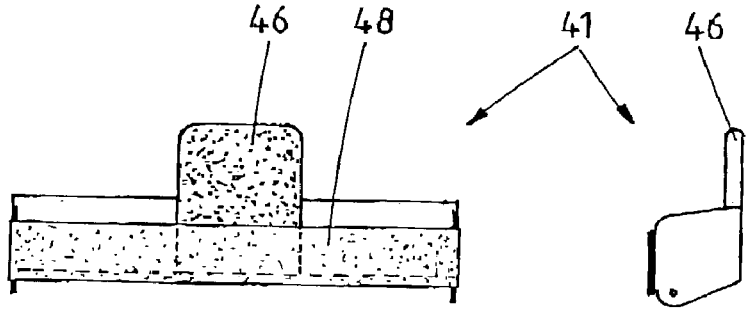
FIGS. 5 and 6 are front, side and top views of a support element employed in the embodiment of FIG. 4.
Figure 6:
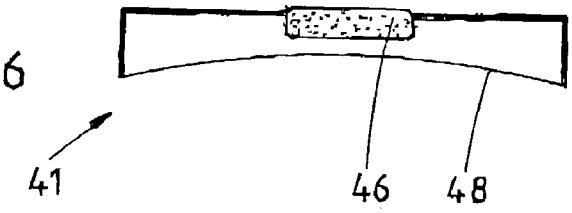

The principle of the basic support is shown in side elevation in FIG. 4. The supporting element 41 is pivotably mounted on a frame 42 and can be adjusted individually for height H, by means of a telescopic arm 43, and for depth D with respect to the seat 44. To this end, the seat 44 is attached to the frame 41 by means of linear guides 45. FIG. 5 shows a front view and a side view of the basic supporting element 41. FIG. 6 is a top plan view. A relatively small rectangular supporting element 46 centrally supports the lumbar-thoracic region of the spine, upwards from the deepest point of the lumbar region. The posture of the upper body 47 in space is thus defined. In the lumbar region a construction is fitted in transverse direction, to both outer sides of which construction a narrow, preferably flexible band 48 is attached, which band 48 extends in upward direction from the deepest point of the lumbar region. Said band 48 easily adapts to the individual shape of the back and provides basic support in transverse direction. By means of this central supporting element 41 a desired posture can be individually defined. If a general, stable, relaxed posture is desired, said supporting element 41 can be offered or be pre-set in a more or less fixed angle in a range of 25° to 35° e.g. about 30° off plumb. After all, said angle is independent of the individual back type.

In this respect, reference may be had to FIG. 2. The position in forward-rearward direction with respect to the seat, as well as the individual height with respect to the deepest point of the lumbar region, still need to be adjusted individually, of course. Care should be taken that a proper ratio between the seat angle and the sitting angle be maintained (FIGS. 1: 4 and 3). In principle it is possible to define the individual posture, the position of the upper body in space, by means of this basic supporting element. What comes after that is individual support.

Figure 7:
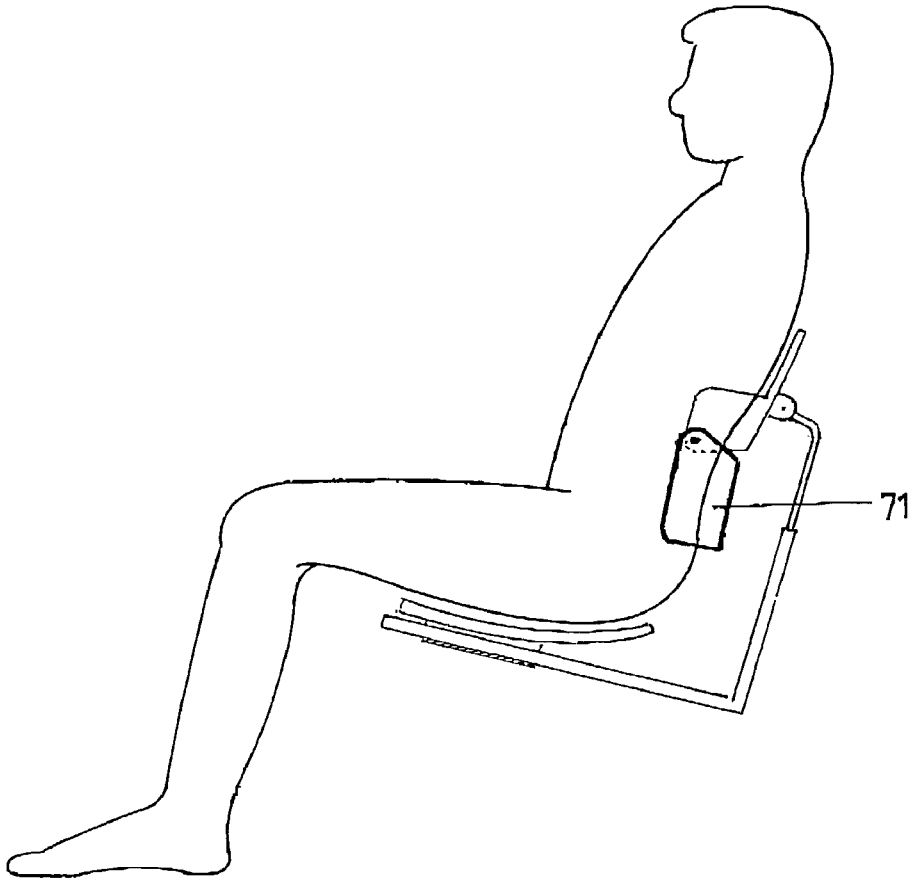
FIG. 7 is a side view of use of a support in accordance with a second embodiment of the present invention.
Figure 8:
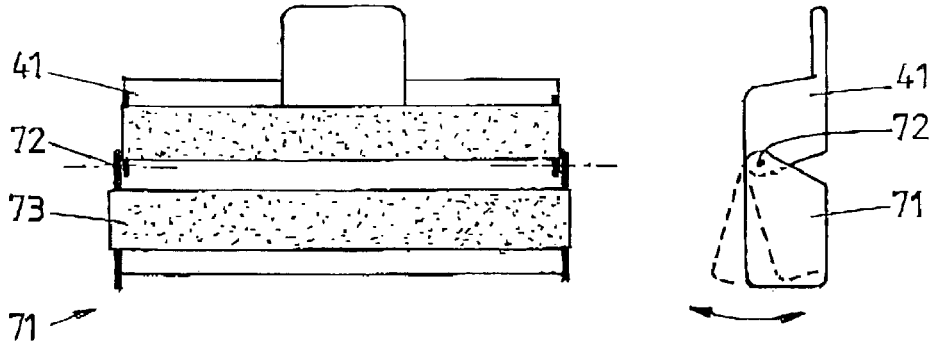
FIG. 8 is a view of the front and side of a support element employed in the embodiment of FIG. 7.

FIG. 7 shows a functional side view. The supporting element 71 of the pelvis is pivoted to the bottom side of the central supporting element 41. The pivot pin 72 extends in transverse direction near the deepest point of the lumbar region of the spine. FIG. 8 shows a front view and a side view of a construction principle. The bands that are shown in the drawing of FIG. 8 jointly form the specific lumbar support. Since said element can move to the front and to the rear with respect to the supporting element 41, lumbar lordosis (FIG. 2:1) as well as lumbar kyfosis (FIG. 2:4), and all possibilities therebetween, can be accommodated . This element 71 also preferably comprises a flexible, non-stretch material 73 that follows the individual contour of the body in transverse direction.

Figure 9:
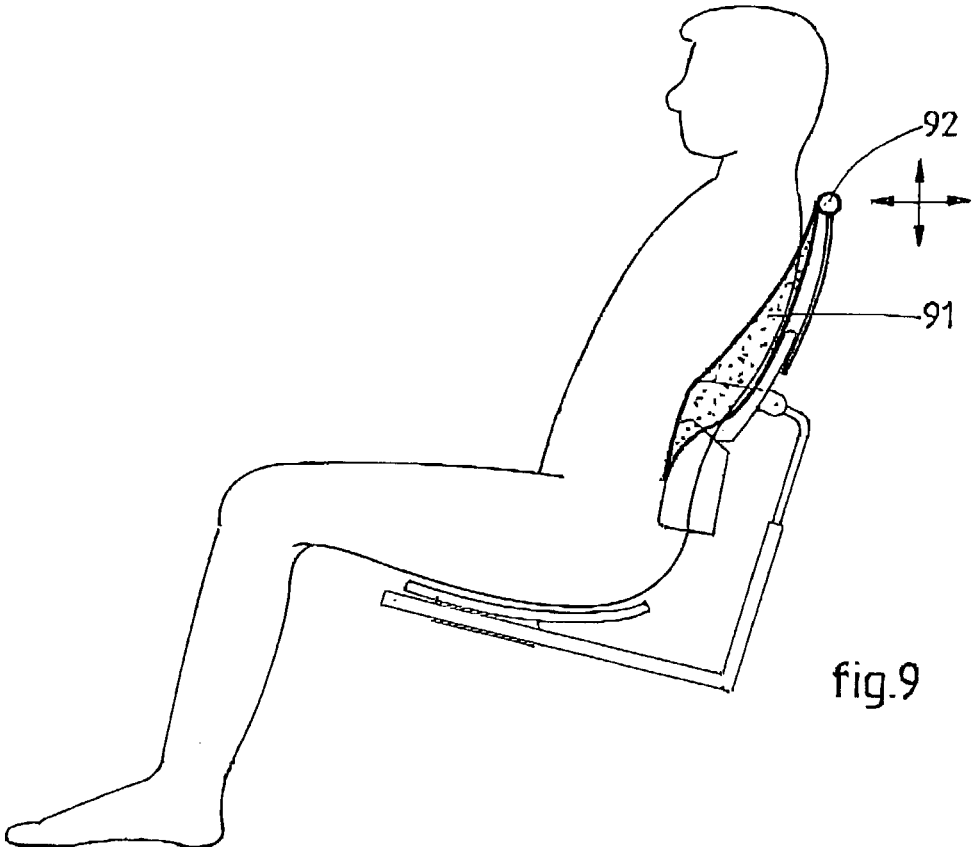
FIG. 9 is a side view of use of a support in accordance with a third embodiment of the present invention.
Figure 10:
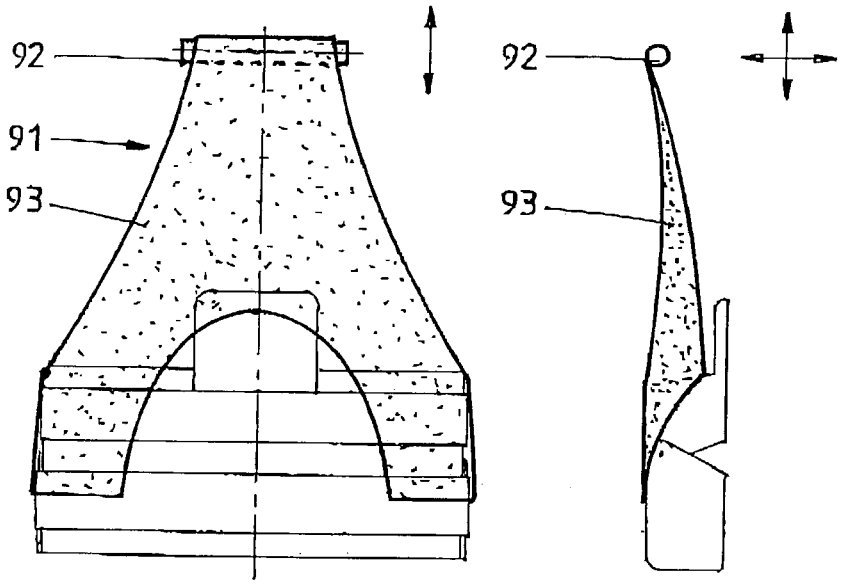
FIG. 10 is a view of the front and side of a support element employed in the embodiment of FIG. 9.

At the upper side of the central supporting element 41 the thoracic region of the spine (FIG. 1: BC) is further supported in upward direction by a flexible supporting element 91, which is attached to a relatively narrow, horizontal constructional element 92 in such a manner as to be centrally adjustable, which latter element 92 can be individually positioned behind the thoracic-cervical transition region and which is attached at its bottom side to both sides of the central supporting element 41, possibly continuing to the pelvis supporting element 71. FIG. 9 shows the functional principle thereof. The manner of attachment and the triangular shape of the flexible material 91 assist in providing a maximum adaptation to the individual thoracic body shape when the supporting element 41 is loaded. FIG. 10 shows a front view of a functional principle.

In principle all flexible supporting elements can be designed so as to enable individual tensioning. The backrest can be lined with a thin layer of foam upholstered with a stretch-type cover.

The individual optimization of a semi-active, stable and relaxed sitting posture starts with the pre-setting of the central supporting element, which is about 25–30° off plumb. Starting from this posture, possible fine-adjustments can be made. The other supporting elements are loosened, so that they do not have a supporting function. Then the central supporting element is adjusted with respect to the seat in accordance with the user's back type. In the case of lordosis, it is adjusted before the rear side of the seat. The angle that the seat builds with the horizontal is set so that the angle between the loaded seat (i.e. a seat in which a person is seated) and the loaded backrest is about 95–115°, preferably about 95–105°. These ranges are generally preferred for the angle between the seat and the backrest. Frictional forces are thus eliminated. After the user has sat down on the seat in accordance with the seat instructions (some seats distribute the pressure best when the ischia are positioned at the intended spot on the seat), fine-adjustment takes place. The posture of the central supporting element with respect to the seat and the height with respect to the back are verified and possibly adjusted. Possibly, the angle of the central supporting element is adjusted in order to optimise the posture. The criterion for this is that the head must take up a relaxed posture on the torso. Then the pelvis supporting element is moved towards the pelvis and fixed in posture. Following that, the central, horizontal constructional element is positioned near the thoracic-cervical transition region approximately 15 mm outside the body. The flexible supporting material is tensioned over said constructional element in downward direction. This approach provides an optimum individual posture support.

In principle the present invention can be used in all types of chairs that are intended to enable individual optimization of the posture support. Especially car or aircraft seats, armchairs, office chairs and wheelchairs can be considered in this connection. The concept is eminently suited for use in foldable wheelchairs , because of the flexibility of the supporting material. Furthermore, it is conceivable to use pre-formed supporting elements of a non-flexible material for some applications. In principle the adjustments can be so designed that they can be operated and fixed by the user himself. This principle, or part thereof, is also suitable for posture support in reclining bicycles. The individually adjustable constructional element in the thoracic-cervical transition region (FIG. 1:C) defines the posture so typical of reclining bike-riders by a considerable thoracic kyphosis. The use of perforated material not only provides a perfect individual support, but it also makes it possible to meet other important requirements, such as moisture regulation.

What is claimed is:

1. A device for supporting a back of a seated person, comprising a seat and a support for the lumbar-thoracic transition region, which is connected to the seat, the support for the lumbar-thoracic transition region being adapted to engage a lumbar-thoracic transition region of the back, an adjustable lumbar-sacral support being adapted to engage a lumbar-sacral region of the back, which is mounted at a location of a lower side of the support for the lumbar-thoracic transition region, wherein the support for the lumbar-thoracic transition region and seat can be adjusted for height with respect to each other and wherein the lumbar-sacral support is adjustable to a selected fixed position relative to the support for the lumbar-thoracic transition region during use.

2. A device according to claim 1, wherein the lumbar-sacral support can be adjusted over a range which enables forming both a convex support and a concave support together with the support for the lumbar-thoracic transition region.

3. A device according to claim 2, wherein an adjustable support is furthermore provided for the thoracic-cervical transition region, which support is mounted at the location of the upper side of the support for the lumbar-thoracic transition region.

4. A device according to claim 2, wherein the lumbar-sacral support and/or the support for the thoracic-cervical transition region is/are pivoted to the support for the lumbar-thoracic transition region, being capable of pivoting movement about a substantially horizontal, imaginary axis.

5. A device according to claim 2, wherein the angle that the seat builds with the horizontal is set so that the angle between the loaded seat and the loaded backrest is in the range from about 95° to about 115°.

6. A device according to claim 2, wherein the support for the lumbar-thoracic transition region and the seat can be adjusted to the front and to the rear with respect to each other.

7. A device according to claim 2, wherein the angle of the support for the lumbar-thoracic transition region is adjustable with respect to the seat and/or wherein the seat is adjustable relative to the horizontal.

8. A device according to claim 2, wherein at least one of said supports is made of a flexible, low-stretch material that easily adapts to the body contour.

9. A device according to claim 1, wherein an adjustable support is furthermore provided for the thoracic-cervical transition region, which support is mounted at the location of the upper side of the support for the lumbar-thoracic transition region.

10. A device according to claim 1, wherein the lumbar-sacral support and/or the support for the thoracic-cervical transition region is/are pivoted to the support for the lumbar-thoracic transition region, being capable of pivoting movement about a substantially horizontal, imaginary axis.

11. A device according to claim 1, wherein the support for the lumbar-thoracic transition region and the seat can be adjusted to the front and to the rear with respect to each other.

12. A device according to claim 1, wherein the angle of the support for the lumbar-thoracic transition region is adjustable with respect to the seat and/or wherein the seat is adjustable relative to the horizontal.

13. A device according to claim 1, wherein at least one of said supports is made of a flexible, low-stretch material that easily adapts to the body contour.

14. A device according to claim 1, wherein at least one of said supports comprises a shell having an anatomic shape, which is lined with a foam-like material.

15. A device according to claim 1, wherein the angle that the seat builds with the horizontal is set so that the angle between the loaded seat and the loaded backrest is in the range from about 95° to about 115°.

16. A method for adjusting, designing and/or manufacturing a device for supporting a seated person, comprising a seat, a support for the lumbar thoracic transition region, and a lumbar-sacral support, wherein said person sits down on the seat and engages the support for the lumbar-thoracic transition region, after which the position of the lumbar-sacral support is moved to a selected fixed position relative to the support for the lumbar-thoracic transition region during use to engage the lumbar region of said person and wherein the support for the lumbar-thoracic transition region is adjusted prior to adapting the position of the lumbar-sacral support.

17. A method according to claim 16, wherein the lumbar-sacral support is adjusted to form a convex support together with the support for the lumbar-thoracic transition region.

18. A method according to claim 17, wherein said device furthermore comprises a support for the thoracic-cervical transition region, and wherein, once said person leans against said support for the lumbar-thoracic transition region, and preferably after the posture of the lumbar-sacral support has been adapted, the position of said support is adapted to the individual curvature of the thoracic-cervical transition region of said person.

19. A method according to claim 16, wherein said device furthermore comprises a support for the thoracic-cervical transition region, and wherein, once said person leans against said support for the lumbar-thoracic transition region, and preferably after the posture of the lumbar-sacral support has been adapted, the position of said support is adapted to the individual curvature of the thoracic-cervical transition region of said person.

20. Wheelchair or chair comprising a device according to claim 1.

* * * * *